US008013102B2

(12) United States Patent
Matsunaga et al.

(10) Patent No.: US 8,013,102 B2
(45) Date of Patent: Sep. 6, 2011

(54) GOLF BALL

(75) Inventors: Katsuji Matsunaga, Kawagoe (JP); Kazuyoshi Shiga, Kobe (JP); Takeshi Asakura, Kobe (JP); Mikio Yamada, Kobe (JP)

(73) Assignees: Katsuji Matsunaga, Kawagoe (JP); SRI Sports Limited, Kobe (JP)

( * ) Notice: Subject to any disclaimer, the term of this patent is extended or adjusted under 35 U.S.C. 154(b) by 443 days.

(21) Appl. No.: 12/232,614

(22) Filed: Sep. 19, 2008

(65) Prior Publication Data

US 2009/0082136 A1 Mar. 26, 2009

(30) Foreign Application Priority Data

Sep. 21, 2007 (JP) ..... 2007-246005

(51) Int. Cl.
*A63B 37/12* (2006.01)
*C08G 18/44* (2006.01)

(52) U.S. Cl. ..... 528/65; 528/85; 525/467; 473/378

(58) Field of Classification Search ..... None
See application file for complete search history.

(56) References Cited

U.S. PATENT DOCUMENTS

| | | | | |
|---|---|---|---|---|
| 5,070,173 | A * | 12/1991 | Yokota et al. | 528/85 |
| 2003/0065124 | A1* | 4/2003 | Rosenberg et al. | 528/59 |
| 2003/0073515 | A1* | 4/2003 | Yokota | 473/378 |
| 2003/0203771 | A1* | 10/2003 | Rosenberg et al. | 473/371 |
| 2005/0261447 | A1* | 11/2005 | Koshiro et al. | 525/453 |
| 2007/0073031 | A1* | 3/2007 | Nagasawa et al. | 528/85 |

FOREIGN PATENT DOCUMENTS

JP 2002-315850 A 10/2002

* cited by examiner

*Primary Examiner* — David Buttner
(74) *Attorney, Agent, or Firm* — Birch, Stewart, Kolasch & Birch, LLP

(57) ABSTRACT

The present invention aims to improve spin performance and abrasion resistance for a golf ball having a cover using a nonionic polyurethane as a resin component. The golf ball of the present invention is a golf ball including a core and a cover covering the core and in which the cover contains a nonionic polyurethane as a resin component and the nonionic polyurethane has a hard segment content of 24.5% to 34.7% by mass.

8 Claims, No Drawings

GOLF BALL

BACKGROUND OF THE INVENTION

1. Field of the Invention

The present invention relates to a golf ball having a polyurethane cover and more particularly to a golf ball satisfying both spin performance and abrasion resistance.

2. Description of the Related Art

Conventionally balata covers have been widely employed for a cover of golf balls; however, since the balata covers have a problem that the covers are inferior in abrasion resistance, covers using ionomer resins have been developed as a substitute for the balata covers. The covers using ionomer resins have been used widely owing to excellent processability; however, they have high stiffness and hardness and accordingly, problems of insufficient spin performance and inferior controllability have been pointed out.

Therefore, covers using polyurethanes have been developed as a substitute for a balata cover, since polyurethanes are excellent in spinning performance as compared with ionomer resins. For example, Japanese Patent Publication No 2002-315850 A discloses a golf ball including a center made of one or more layers containing a polybutadiene having a molecular weight of more than about 200,000 and a resilience index of at least about 40, a cover having at least one layer containing a polyurethane blend formed from a prepolymer having 7.5% by weight or less of an unreacted isocyanate group, and at least one thread material disposed between the center and the cover, wherein each thread provides at least one wound layer having at least one strand.

SUMMARY OF THE INVENTION

With respect to the golf ball using the polyurethane cover as disclosed in JP No. 2002-315850 A, it was impossible to simultaneously satisfy the spin performance and abrasion resistance. In view of the above circumstances, the present invention has been made with an aim to improve the spin performance and abrasion resistance of a golf ball having a cover using a nonionic polyurethane as a resin component.

A golf ball of the present invention which can solve the above-mentioned problems is a golf ball including a core and a cover covering the core, and the cover contains a nonionic polyurethane as a resin component and the nonionic polyurethane has a hard segment content of from 24.5% to 34.7% by mass. In general, a polyurethane has a hard segment consisting of a polyisocyanate component and a chain extender component and a soft segment consisting of a high molecular weight polyol component. The present inventors have achieved the present invention based on the finding that both of the spin performance and abrasion resistance can be simultaneously satisfied by the use of a nonionic polyurethane having a hard segment content controlled to be from 24.5% to 34.7% by mass as the resin component constituting the cover. The hard segment content of the nonionic polyurethane is more preferably from 25.4% to 28.6% by mass.

Further, the nonionic polyurethane preferably contains a diol having a cyclo ring and/or a benzene ring as the chain extender component and more preferably contains an aromatic diol represented by the following formula (1):

(1)

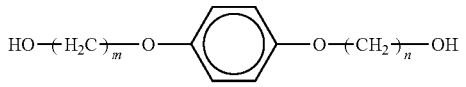

(In the formula, m and n independently denote an integer of 2 to 4.)

Examples of the aromatic diol include hydroquinonebis(2-hydroxyethyl)ether.

Further, the nonionic polyurethane preferably contains a polycarbonate polyol as a polyol component, and more preferably contains a polycarbonate polyol having a repeating unit (A) shown in the following formula (2) and a repeating unit (B) shown in the following formula (3) and having a different structure from that of (A) and a molar ratio of (A)/(B) is from 30/70 to 70/30.

(2)

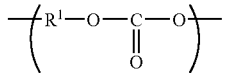

In Formula (2), $R^1$ denotes a bivalent residue obtained by removing two hydroxyl groups from a diol having 4 to 6 carbon atoms; and (3)

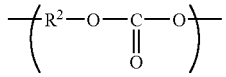

In Formula (3), $R^2$ denotes a bivalent residue obtained by removing two hydroxyl groups from a diol having 4 to 6 carbon atoms.

Preferable examples of the polycarbonate polyol includes a polycarbonate polyol where $R^1$ denotes a bivalent residue obtained by removing two hydroxyl groups from 1,5-pentanediol and $R^2$ denotes a bivalent residue obtained by removing two hydroxyl groups from 1,6-hexanediol, and the mole ratio of (A)/(B) is 50/50.

According to the present invention, in a golf ball comprising a cover using a nonionic polyurethane as a resin component, a golf ball excellent in the spin performance and abrasion resistance can be provided.

DETAILED DESCRIPTION OF THE PREFERRED EMBODIMENTS

The present invention provides a golf ball comprising a core and a cover covering the core, wherein the cover contains a nonionic polyurethane as a resin component and the nonionic polyurethane has a hard segment content of from 24.5% to 34.7% by mass.

First, the nonionic polyurethane to be used as the resin component of the cover of the golf ball of the present invention will be described. The nonionic polyurethane is not particularly limited, as long as it is nonionic and has a plurality of urethane bonds in a molecular chain thereof and a hard segment content of from 24.5% to 34.7% by mass. Examples thereof include a reaction product produced by the reaction of a polyisocyanate component, a high molecular weight polyol component and a chain extender component, and having urethane bonds in the molecule thereof. In the present invention, the "nonionic polyurethane" means a polyurethane having no ionized part (ion center). Further, in the present invention, the "hard segment content of the nonionic polyurethane" means the total content of the polyisocyanate component and the chain extender component in the nonionic polyurethane and can be defined as follows:

"Hard segment content (% by mass)"=100×(polyisocyanate component (*g*)+chain extender component (*g*))/total amount of nonionic polyurethane (*g*).

The hard segment content of the nonionic polyurethane is preferably 24.5% by mass or higher, more preferably 25.4% by mass or higher, and even more preferably 26.0% by mass or higher, and preferably 34.7% by mass or lower, more preferably 28.6% by mass or lower, and even more preferably 28.0% by mass or lower. If the hard segment content of the nonionic polyurethane exceeds 34.7% by mass, the cover becomes so hard that the spin rate is lowered and if it is less than 24.5% by mass, the cover becomes so soft that the abrasion resistance is lowered.

The reason for the improvement in the abrasion resistance and the spin performance of the cover by adjusting the hard segment content of the nonionic polyurethane within the above-mentioned range is supposed as follows. That is, if the hard segment content of the nonionic polyurethane is within the above-mentioned range, the hard domains (polyisocyanate component and chain extender component) are not bonded with each other and the soft segment (high molecular weight polyol component) exists between hard domains, and therefore the cover becomes property soft, the surface area to be brought into contact with a club at the time of hitting is widened and the frictional force is increased to improve the spin performance. Further, the improvements in strength of the cover owing to the hard domains and the elongation of the cover owing to the soft segment are simultaneously satisfied in good balance to improve the abrasion resistance.

The polyisocyanate component constituting the nonionic polyurethane is not limited, as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate (TMXDI), para-phenylene diisocyanate (PPDI), an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used either alone or as a mixture of at least two of them.

In view of improving the abrasion-resistance, an aromatic polyisocyanate is preferably used as the polyisocyanate component of the polyurethane. A use of the aromatic polyisocyanate improves the mechanical property of the obtained polyurethane and provides the cover with the excellent abrasion-resistance. In addition, in view of improving the weather resistance, as the polyisocyanate component of the polyurethane, a non-yellowing type polyisocyanate such as TMXDI, XDI, HDI, $H_6$XDI, IPDI and $H_{12}$MDI is preferably used. More preferably, 4,4'-dicyclohexylmethane diisocyanate ($H_{12}$MDI) is used. Since 4,4'-dicyclohexylmethane diisocyanate ($H_{12}$MDI) has a rigid structure, the mechanical property of the resulting polyurethane is improved, and thus the cover which is excellent in abrasion-resistance can be obtained.

The polyol component constituting the nonionic polyurethane is not limited, as long as it is a high molecular weight polyol having a plurality of hydroxyl groups. Examples of the polyol are a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ϵ-caprolactone (PCL); a polycarbonate polyol; and an acrylic polyol. The above polyols may also be used as a mixture of at least two of them.

Among them, the polycarbonate polyol is preferably used as a polyol component. Herein, "polycarbonate polyol", which is well known to those skilled in the art, is a compound having a plurality of terminal hydroxyl groups, where the low-molecular weight diol components and the like are bonded via a carbonate bond. Among the polycarbonate polyol, preferably used is the polycarbonate polyol having, as the repeating constitutional unit, the repeating unit (A) shown in the following Formula (2) and the repeating unit (B) shown in the following Formula (3) which has a different structure from that of (A).

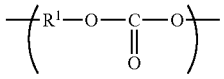

(2)

In Formula (2), $R^1$ is a bivalent residue obtained by removing two hydroxyl groups from a diol having 4 to 6 carbon atoms

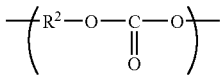

(3)

In Formula (3), $R^2$ is a bivalent residue obtained by removing two hydroxyl groups from a diol having 4 to 6 carbon atoms.

The molar ratio of the repeating unit (A)/the repeating unit (B) is preferably from 30/70 to 70/30, more preferably from 40/60 to 60/40, even more preferably 50/50. If either of the molar ratio (A) and (B) is too high, the crystallinity of the resultant polycarbonate polyol becomes too high, and thus the abrasion-resistance of the resulting urethane cover is lowered.

Herein, $R^1$ of the repeating unit (A) and $R^2$ of the repeating unit (B) are not limited as long as $R^1$ and $R^2$ are different each other and bivalent residues where two hydroxyl groups have been removed from a diol having 4 to 6 carbon atoms. The crystallinity of the polycarbonate polyol is suppressed by employing different structures as the structures of $R^1$ and $R^2$.

Examples of the diol having 4 to 6 carbon atoms include a diol having 4 carbon atoms such as 1,2-butanediol, 1,3-butanediol, 1,4-butanediol, 1-methyl-1,3-propanediol, 2-methyl-1,3-propane dial; a diol having 5 carbon atoms such as 1,2-pentanediol, 1,3-pentanediol, 1,4-pentanediol, 1,5-pentanediol, 1,2-cyclopentanediol, 1,3-cyclopentanediol, 1,1-dimethyl-1,3-propanediol, 2,2-dimethyl-1,3-propanediol, 1,3-dimethyl-1,3-propanediol, 1-ethyl-1,3-propanediol, 2-ethyl-1,3-propanediol, 1-methyl-1,4-butanediol, 2-methyl-1,4-butanediol; a diol having 6 carbon atoms such as 1,2-hexanediol, 1,3-hexanediol, 1,4-hexanediol, 1,5-hexanediol, 1,6-hexanediol, 1,4-cyclohexane diol, methyl pentanediol, dimethyl butanediol, ethyl butanediol, trimethyl propanediol, and methylethyl propanediol. Examples of the polycarbonate polyol include the polycarbonate polyol wherein $R^1$ is a bivalent residue in which two hydroxyl groups have been removed from 1 4-butanediol, 1,5-pentanediol or 1,6-hexanediol. Preferable examples are the polycarbonate polyol where $R^1$ is the bivalent residue obtained by removing two hydroxyl groups from 1,4-butanediol and $R^2$ is the bivalent residue obtained by removing two hydroxyl groups from 1,6-hexanediol, and the polycarbonate polyol where $R^1$ is the bivalent residue obtained by removing two hydroxyl groups from 1,5-pentanediol and $R^2$ is the bivalent residue obtained by removing two hydroxyl groups from 1,6-hexanediol.

The high molecular weight polyol used in the present invention preferably has a number average molecular weight of 1000 or more, more preferably 1500 or more, even more preferably 2000 or more and preferably has a number average molecular weight of 4000 or less, more preferably 3500 or less, even more preferably 3000 or less. In addition, the high molecular weight polyol used in the present invention preferably has a hydroxyl group value of 112 mg KOH/g or less, more preferably 74.8 mg KOH/g or less, even more preferably 56.1 mg KOH or less, and preferably has a hydroxyl group value of 28.0 mg KOH/g or more, more preferably 32.0 mg KOH/g or more, even more preferably 37.4 mgKOH/g or more. Furthermore, the hydroxyl group value of the polycarbonate polyol can be measured by the acetylation method according to JIS K 1557-1.

The chain extender component constituting the nonionic polyurethane preferably includes a low-molecular weight polyol and polyamine. Examples of the low-molecular weight polyol may include a diol such as ethylene glycol, diethylene glycol, triethylene glycol, 1,3-butanediol, 1,4-butanediol, neopentyl glycol, 1,6-hexanediol; a diol having a cyclo ring and/or a benzene ring; and a triol such as glycerin, trimethylol propane, and hexane triol. These low-molecular weight polyol may be used alone or in combination of at least two of them. Among them, the diol having a cyclo ring and/or a benzene ring is preferably used as the chain extender component.

The diol having a cyclo ring and/or a benzene ring preferably includes an aromatic diol represented by the following formula (1).

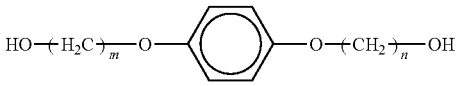

(1)

In Formula (1), m and n independently denote an integer of 2 to 4.

The aromatic diol represented by the formula (1), for example, includes hydroquinonebis(2-hydroxyethyl)ether.

Furthermore, a low-molecular weight polyamine to be used as the chain extender is not limited as long as it has at least two amino groups. Examples of the polyamine include an aliphatic polyamine such as ethylenediamine, propylenediamine, butylenediamine, and hexamethylenediamine, an alicyclic polyamine such as isophoronediamine and piperazine, and an aromatic polyamine.

The aromatic polyamine has no limitation as long as it has at least two amino groups directly or indirectly bonded to an aromatic ring. Herein, the "indirectly bonded to the aromatic ring", for example, means that the amino group is bonded to the aromatic ring via a lower alkylene bond. Further, the aromatic polyamine includes, for example, a monocyclic aromatic polyamine having at least two amino groups bonded to one aromatic ring or a polycyclic aromatic polyamine having at least two aminophenyl groups each having at least one amino group bonded to one aromatic ring.

Examples of the monocyclic aromatic polyamine include a type such as phenylenediamine, tolylenediamine, diethyltoluenediamine, and dimethylthiotoluenediamine wherein amino groups are directly bonded to an aromatic ring; and a type such as xylylenediamine wherein amino groups are bonded to an aromatic ring via a lower alkylene group. Further, the polycyclic aromatic polyamine may include a poly (aminobenzene) having two aminophenyl groups directly bonded to each other or a compound having at least two aminophenyl groups bonded via a lower alkylene group or an alkylene oxide group. Among them, a diaminodiphenylalkane having two aminophenyl groups bonded to each other via a lower alkylene group is preferable. Typically preferred are 4,4'-diaminodiphenylmethane and the derivatives thereof. These low-molecular weight polyamines may be used alone or in combination of at least two of them. Further, the low-molecular weight polyamine may be used in combination with the low-molecular weight polyol.

These low-molecular weight polyol and low-molecular weight polyamine used as the chain extender preferably has a molecular weight of 800 or less, more preferably 600 or less, even more preferably 400 or less.

The cover of the golf ball of the present invention is not particularly limited as long as it contains, as a resin component, the nonionic polyurethane having the above-mentioned hard segment content of from 24.5% to 34.7% by mass. For example, the cover preferably contains the nonionic polyurethane in an amount of 50 parts by mass or higher, more preferably 60 parts by mass or higher, and even more preferably 70 parts by mass or higher with respect to 100 parts by mass of the resin component. Further, it is preferable that the cover essentially consists of the nonionic polyurethane as a resin component. The nonionic polyurethane may be a so-called thermoplastic polyurethane or thermosetting polyurethane. The thermoplastic polyurethane is a polyurethane showing plasticity by heating and generally means a polyurethane having a linear structure with a high molecular weight to a certain extent. On the other hand, the thermosetting polyurethane (two-component curable polyurethane) is a polyurethane obtained by reacting a low molecular weight urethane prepolymer which is once preserved with a chain extending agent (curing agent) to increase the molecular weight immediately before forming the cover. The thermosetting polyurethane include polyurethanes with a linear-chain structure and polyurethanes with a three-dimensional cross-linked structure by controlling the number of functional groups in the prepolymer or the chain extending agent (curing agent) to be used.

The other resin component, which may be used in combination with the nonionic polyurethane, include a thermoplastic polyamide elastomer having a commercial name of "PEBAX" such as "PEBAX 2533" available from ARKEMA Inc., a thermoplastic polyester elastomer having a commercial name of "HYTREL" such as "HYTREL 3548" and "HYTREL 4047" available from DU PONT-TORAY Co., a thermoplastic polyurethane elastomer having a commercial name of "ELASTOLLAN" such as "ELASTOLLAN XNY97A" available from BASF Polyurethane Elastomers, a thermoplastic polystyrene elastomer having a commercial name of "Rabalon" available from Mitsubishi Chemical Co., as well as the conventional ionomer resin.

In the present invention, the cover may contain, in addition to the above mentioned resin component, a pigment component such as zinc oxide, titanium oxide, and a blue pigment, a gravity adjusting agent such as calcium carbonate and barium sulfate, a dispersant, an antioxidant, an ultraviolet absorber, a light stabilizer, a fluorescent material or fluorescent brightener and the like as long as the cover performance is not undermined.

The content of the white pigment (titanium oxide) is preferably 0.5 part by mass or more, more preferably 1 part by mass or more, and preferably 10 parts by mass or less, more preferably 8 parts by mass or less based on 100 parts by mass of the resin component constituting the cover. The white pigment in an amount of 0.5 part by mass or more can impart opacity to the cover, while the white pigment in an amount of more than 10 parts by mass may lower the durability of the resulting cover.

The cover for a golf ball of the present invention can be prepared by molding the cover composition containing the above-mentioned nonionic polyurethane as a resin component. Examples of a method for molding a cover include a method wherein the cover composition is subjected to compression molding into hollow-shell shape, and the core is covered with a plurality of shells (preferably a method wherein a cover composition is compression-molded into hollow-half shell shape and the core is covered with two half shells), and a method wherein the cover composition is subjected to direct injection molding onto the core.

Molding of the half shell can be performed by either compression molding method or injection molding method, and the compression molding method is preferred. The compression-molding of the cover composition into half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed.

According to the present invention, the cover composition can be subjected to injection molding directly onto the core. In such a case, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition is fed into the mold and then cooled to obtain a cover. For example, the cover composition heated to 150° C. to 250° C. is charged into a mold held under the pressure of 9 MPa to 15 MPa in 0.5 to 5 seconds, and cooled for 10 to 60 seconds, prior to opening the mold.

When molding a cover, the surface of the golf ball may be formed with dimples. Where necessary, the golf ball body with the cover molded is discharged from the mold and is preferably subjected to surface treatment such as deburring, cleaning, and sandblast. If desired, a paint film or a mark may be formed.

In the present invention, the golf-ball preferably has the urethane cover with a thickness of 1.0 mm or less, more preferably 0.6 mm or less, even more preferably 0.5 mm or less. If the thickness is 1.0 mm or less, the outer diameter of the core can be increased, thus the resilience is enhanced. The lower limit of the thickness of the urethane cover is, for example, but not limited to, 0.3 mm. If the thickness is less than 0.3 mm, the molding of the urethane cover may become difficult.

The urethane cover preferably has the slab hardness of 20 or more, more preferably 25 or more, and preferably has the slab hardness of 50 or less, more preferably 45 or less in shore D hardness. If the cover hardness is less than 20, the flying distance may be lowered due to the lowered resilience of the resultant golf ball. On the other hand, if the cover hardness is more than 50, the durability of the obtained golf ball may be lowered. The slab hardness of the cover can be measured by forming the cover composition into sheets having a thickness of about 2 mm by hot press molding, keeping the sheets for two weeks at the temperature of 23 C.°, and stacking three or more of the sheets on one another to avoid being affected by the measuring substrate on which the sheets were placed for measurement using the Shore D type spring hardness tester prescribed by ASTM-D2240.

Next, a preferred embodiment of the core of the golf ball of the present invention will be explained.

The core of the golf ball of the present invention includes a single-layered core, a core consisting of a center and a single-layered intermediate layer covering the core, a core consisting of a center and a plurality of intermediate layers, or a core consisting of a center and a multi-layered intermediate layers. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs, preferably the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center. For example, if the surface of the spherical center is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

As the core or the center of the golf ball of the present invention, a conventionally known rubber composition (hereinafter simply referred to as "rubber composition for the core" occasionally) may be employed, and it can be molded by, for example, heat-pressing a rubber composition containing a base rubber, a crosslinking initiator, a co-crosslinking agent, and a filler.

As the base rubber, a natural rubber and/or a synthetic rubber such as a polybutadiene rubber, a natural rubber, a polyisoprene rubber, a styrene, polybutadiene rubber, and ethylene-propylene-diene terpolymer (EPDM) may be used. Among them, typically preferred is the high cis-polybutadiene having cis-1,4 bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.2 part by mass or more, more preferably 0.3 part by mass or more, and preferably 3 parts by mass or less, more preferably 2 parts by mass or less based on 100 parts by mass of the base rubber. If the amount is less than 0.2 part by mass, the core becomes too soft, and the resilience tends to be lowered, and if the amount is more than 3 parts by mass, the amount of the co-crosslinking agent needs to be increased in order to obtain an appropriate hardness, so that the resilience tends to be insufficient.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience. The amount of the co-crosslinking agent to be used is preferably 10 parts or more, more preferably 20 parts or more, and is preferably 50 parts or less, more preferably 40 parts or less based on 100 parts of the base rubber by mass. If the amount of the co-crosslinking agent to be used is less than 10 parts by mass, the amount of the organic peroxide must be increased to obtain an appropriate hardness which tends to lower the resilience. On the other hand, if the amount of the co-crosslinking agent to be used is more than 50 parts by mass, the core becomes too hard, so that the shot feeling may be lowered.

The filler contained in the rubber composition for the core is mainly blended as a gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts or more, more preferably 3 parts or more, and preferably 50 parts or less, more preferably 35 parts or less based on 100 parts of the base rubber by mass. If the amount of the filler to be blended is less than 2 parts by mass, it becomes difficult to adjust the weight, while if it is more than 50 parts by mass, the weight ratio of the rubber component becomes small and the resilience tends to be lowered.

As the rubber composition for the core, an organic sulfur compound, an antioxidant or a peptizing agent may be blended as appropriate in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis (4-chlorophenyl) disulfide, bis(3-chlorophenyl) disulfide, bis (4-bromophenyl) disulfide, bis(3-bromophenyl) disulfide, bis (4-fluorophenyl) disulfide, bis(4-iodophenyl) disulfide and bis(4-cyanophenyl) disulfide; a di-substituted diphenyl disulfide such as bis(2,5-dichlorophenyl) disulfide, bis (3,5-dichlorophenyl) disulfide, bis(2,6-dichlorophenyl) disulfide, bis (2,5-dibromophenyl) disulfide, bis(3,5-dibromophenyl) disulfide, bis (2-chloro-5-bromophenyl) disulfide, and bis(2-cyano-5-bromophenyl) disulfide; a tri-substituted diphenyl disulfide such as bis(2,4,6-trichlorophenyl) disulfide, and bis (2-cyano-4-chloro-6-bromophenyl) disulfide; a tetra-substituted diphenyl disulfide such as bis(2,3,5,6-tetra chlorophenyl) disulfide; a penta-substituted diphenyl disulfide such as bis(2,3,4,5,6-pentachlorophenyl) disulfide and bis (2,3,4,5,6-pentabromophenyl) disulfide. These diphenyl disulfides or the derivative thereof can enhance resilience by having some influence on the state of vulcanization of vulcanized rubber. Among them, diphenyl disulfide and bis (pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5-0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the peptizing agent is preferably 0.1 part or more and is preferably 5 parts or less based on 100 parts of the base rubber by mass.

The conditions for press-molding the rubber composition should be determined depending on the rubber composition. The press-molding is preferably carried out for 10 to 60 minutes at the temperature of 130 to 200° C. Alternatively, the press-molding is preferably carried out in a twostep heating, for example, for 20 to 40 minutes at the temperature of 130 to 150° C., and continuously for 5 to 15 minutes at the temperature of 160 to 180° C.

When preparing a three-piece golf ball or a multi-piece golf ball, as the intermediate layer, for example, a thermoplastic polyamide elastomer having a commercial name of "PEBAX", for example, "PEBAX 2533", available from ARKEMA Inc; a thermoplastic polyester elastomer having a commercial name of "HYTREL", for example, "HYTREL 3548" and "HYTREL 4047" available from DU PONT-TORAY Co.; a thermoplastic polystyrene elastomer having a commercial name of "Rabalon" available from Mitsubishi Chemical Co.; and a thermoplastic polyurethane elastomer having a commercial name of "ELASTOLLAN", for example, "ELASTOLLAN XNY97A" available from BASF Japan may be used in addition to the cured product of the rubber composition and the conventional ionomer resins. Examples of the ionomer resin include an ionomer resin prepared by neutralizing at least a part of carboxyl groups in a copolymer composed of ethylene and α,β-unsaturated carboxylic acid with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof.

Specific examples of the ionomer resins include, but not limited to, Himilan 1555(Na), Himilan 1557(Zn), Himilan 1605(Na), Himilan 1706(Zn), Himilan, 1707(Na), Himilan AM7311 (Mg), and examples of the ternary copolymer ionomer resin include Himilan 1856(Na) and Himilan 1855(Zn) available from MITSUI-DUPONT POLYCHEMICAL CO., LTD.

Further, ionomer resins available from DUPONT CO. include Surlyn 8945(Na), Surlyn 9945(Zn), Surlyn 8140(Na), Surlyn 8150(Na), Surlyn 9120(Zn) Surlyn 9150 (Zn), Surlyn 6910(Mg), Surlyn 6120(Mg), Surlyn 7930(Li), Surlyn 7940(Li), Surlyn AD8546(Li), and examples of the ternary copolymer ionomer resin include Surlyn 8120(Na), Surlyn 8320(Na), Surlyn 9320(Zn), and Surlyn 6320(Mg).

Ionomer resins such as Iotek 8000(Na), Iotek 8030(Na), Iotek 7010(Zn), and Iotek 7030(Zn) are available from Exxon Co. Examples of the ternary copolymer ionomer resin include Iotek 7510(Zn) and Iotek 7520(Zn).

Na, Zn, K, Li, or Mg described in the parentheses after the commercial name of the ionomer resin represents a kind of metal used for neutralization. The intermediate layer may further contain a gravity adjusting agent such as barium sulfate and tungsten, an antioxidant, a pigment and the like.

The diameter of the core of the golf ball of the present invention is preferably 30 mm or more, more preferably 32 mm or more, and is preferably 41 mm or less, more preferably 40.5 mm or less. If the diameter of the core is less than 30 mm, the thickness of the cover or the intermediate layer must be thicker than the desired thickness, so that the resilience is lowered. If the diameter of the core is more than 41 mm, the cover becomes thinner than the desired thickness, so that the cover or the intermediate layer does not function sufficiently.

Further, a compression deformation amount (deformation amount along the shrinkage direction of the core) of the core when applying a load from 98 N as an initial load to 1275 N as a final load is preferably 2.5 mm or more, more preferably 3.4 mm or more, and is preferably 5.0 mm or less, more preferably 4.5 mm or less. If the above deformation amount is less than 2.5 mm, the shot feeling tends to be lowered, while if the above deformation amount is more than 5.0 mm, the repulsion may be lowered.

In one preferable embodiment, the core has the difference in the hardness between the center and the surface thereof. The difference in JIS-C hardness between the central hardness and the surface hardness is preferably at least 10, more preferably at least 12, and is preferably not more than 40, more preferably not more than 35, even more preferably not more than 30. If the difference in hardness is more than 40, the durability will be lowered, while if the difference in hardness is less than 10, the shot feeling becomes hard and thus the impact is getting large. The core preferably has the surface hardness of at least 65, more preferably at least 70, even more preferably at least 72 in JIS-C hardness, and preferably has the surface hardness of not more than 85 at the surface portion thereof. If the core has the surface hardness of less than 65 in JIS-C hardness, the core becomes too soft and the resilience is lowered. As a result, the flight distance becomes low. On the other hand, if the core has the surface hardness of more than 85, since the core is too hard, the shot feeling becomes bad. The core preferably has the central hardness of at least 45, more preferably at least 50, and preferably has the central hardness of 70 or less, more preferably 65 or less in JIS-C hardness at the central portion thereof. If the core has the central hardness less than 45, the core becomes too soft and thus the durability is lowered. If the core has the central hardness of more than 70, since the core is too hard, the shot feeling becomes bad. The difference in hardness is provided by appropriately selecting the heat-molding condition of the core.

A structure of the golf ball of the present invention is not particularly limited as long as it has a core and a cover. It may be a two-piece golf ball having a core and a cover covering the core; a three-piece golf ball having a core consisting of a center and an intermediate layer covering the center and the cover covering the core; a multi-piece golf ball having a core consisting of a center and a plurality of or multi-layered intermediate layers covering the center, and a cover covering the core, or an would-core golf ball having an wound core and an outer most cover covering the wound core. In any case, the present invention can be suitably applied. Among them, the present invention can be preferably applied to the two-piece golf ball having a core and a cover covering the core.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Method]

(1) Slab Hardness (Shore D Hardness)

The cover compositions were each formed into sheets each having a thickness of about 2 mm by hot press molding and the resulting sheets were maintained at 23 C.° for two weeks. Three or more of the sheets were stacked on one another to avoid being affected by the measuring substrate on which the sheets were placed, and the stack was subjected to the measurement using P1 type auto hardness tester provided with the Shore D type spring hardness tester prescribed by ASTM-D2240, available from KOUBUNSHI KEIKI CO., LTD.

(2) Abrasion-Resistance

A commercially available sand wedge was installed on a swing robot available from Golf Laboratory Co., and two points of a ball respectively were hit once at the head speed of 36 m/sec. The areas which were hit were observed, evaluated and ranked into five levels based on following criteria to give the average of the two areas.

5 points: No scratch was present, or scratches were hardly conspicuous.

4 points: A few scratches could be observed, but were barely annoying.

3 points; A little scuffing was present on the surface.

2 points: Scuffing or a lack of dimples was observed on the surface.

1 point: Dimples had been completely scraped away.

(3) Spin Rate (rpm)

Each golf ball was hit with an approach wedge club (SRIXON I-302 available from SRI Sports Limited) attached to a swing robot M/C manufactured by Golf Laboratory Co at the head speed of 21 m/sec, and the spin rate (rpm) was determined by continuously taking a photograph of the spinning golf ball right after hitting the golf ball. The measurement was carried out 10 times for each golf ball and the average of 10 times was regarded as the spin rate of the golf ball.

[Preparation of Three-Piece Golf Ball]

(1) Preparation of Core

The rubber composition for the core shown in Table 1 was kneaded, and was subjected to heat-pressing for 30 minutes in the upper and lower molds having a spherical cavity at the temperature of 140 C.° to obtain a center in a spherical shape having a diameter of 38.5 mm and a weight of 34.9 g.

TABLE 1

| Core composition | Amount (parts) |
|---|---|
| Polybutadiene rubber | 100 |
| Zinc acrylate | 37 |
| Zinc oxide | Appropriate amount* |
| Bis(pentabromophenyl) disulfide | 0.7 |
| Dicumyl peroxide | 0.9 |

*The zinc oxide was suitably added so that the weight of the obtained golf ball becomes 45.4 g.

Notes on Table 1

Polybutadiene rubber: BR730 (high cis-polybutadiene) available from JSR Co.

Zinc acrylate: ZNDA-90S available from NIHON JYORYU KOGYO Co., LTD.

Zinc oxide: "Ginrei R" produced by Toho-Zinc Co.

Dicumyl peroxide: Percumyl D available from NOF Corporation

The zinc oxide was suitably added so that the weight of the obtained golf ball becomes 45.4 g.

Next, as an ionomer resin, 50 parts by mass of "Himilan 1605" available from MITSUI-DUPONT POLYCHEMICAL and 50 parts by mass of "Surlyn 9945"available from DUPONT CO. were mixed in twin-screw kneading extruder to prepare the material for an intermediate layer in the form of the pellet. The extrusion was carried out under the following conditions: screw diameter 45 mm, screw revolutions=200 rpm, screw L/D=35. The material for the intermediate layer was heated at a temperature between 150 C.° and 230 C.° at the die position of the extruder. The multi layered % core (having a diameter of 41.7 mm) consisting of the core and the intermediate layer was prepared by directly inject-molding the obtained material for the intermediate layer onto the core.

(2) Preparation of the Cover Composition

First, preparation of a nonionic polyurethane will be described. A nonionic polyurethane was obtained by charging a polyisocyanate component and a polyol component into a flask at a mixing ratio shown in Table 2, carrying out prepolymerization reaction while stirring the mixture at 60° C. for 3 hours under nitrogen atmosphere. Successively, a chain extender component at a mixing ratio shown in Table 2 was dissolved in N,N-dimethylacetamide (dehydrated) in about 0.5 times as much as the total charged amount (g) of the polyisocyanate component, the polyol components and the chain extender component and the resultant solution was added by drop into the obtained prepolymer by a titration funnel. The chain extension reaction was carried out by stirring the mixture at 60° C. for 2 hours in nitrogen atmosphere while adding a proper amount of N,N-dimethylacetamide (dehydrated) in accordance with the increase in the viscosity. The obtained product was vacuum-dried at 90° C. for 48 hours in a vacuum oven to obtain respective nonionic polyurethanes.

TABLE 2

| | | Nonionic Polyurethane No. | | | | |
|---|---|---|---|---|---|---|
| | | 1 | 2 | 3 | 4 | 5 |
| Polyisocyanate component | MDI (M.W. = 250) | 7 | 6 | 5 | 4 | 2.6 |
| Polyol component | PCDL T 5651 (M.W. = 1000) | 6 | 5 | 4 | 3 | 1.6 |
| Chain Extender component | HBE (M.W. = 198) | 1 | 1 | 1 | 1 | 1 |
| | BD (M.W. = 90) | — | — | — | — | — |
| Hard segment content (mass %) | | 24.5 | 25.4 | 26.6 | 28.6 | 34.7 |

| | | Nonionic Polyurethane No. | | | | | |
|---|---|---|---|---|---|---|---|
| | | 6 | 7 | 8 | 9 | 10 | 11 |
| Polyisocyanate Component | MDI (M.W. = 250) | 8 | 2 | 4 | 6 | 5 | 4 |
| Polyol component | PCDL T 5651 (M.W. = 1000) | 7 | 1 | 1 | 5 | 4 | 3 |
| Chain Extender component | HBE (M.W. = 198) | 1 | 1 | 3 | — | — | — |
| | BD (M.W. = 90) | — | — | — | 1 | 1 | 1 |
| Hard segment content (mass %) | | 23.9 | 41.1 | 61.5 | 24.1 | 25.1 | 26.7 |

Formulation: molar ratio,

M.W.: Molecular Weight

MDI: Sumidur 44S (registered trademark), manufactured by Sumitomo Bayer Urethane Co., Ltd.

PCDL T 5651: polycarbonate polyol (hydroxyl-terminated polyol where a bivalent residue obtained by removing two hydroxyl groups from 1,5-pentanediol and a bivalent residue obtained by removing two hydroxyl groups from 1,6-hexanediol are randomly bonded via carbonate bonds at 50:50 mole ratio), manufactured by Asahi Kasei Chemicals Corporation HBE: hydroquinonebis(2-hydroxyethyl) ether, manufactured by Kanto Chemical Co., Inc.

BD: 1,4-butanediol, manufactured by Kanto Chemical Co., Inc.

Next, the cover material mixtures shown in Table 3 were mixed with a biaxial kneading extruder to obtain respective cover materials in a pellet form. Extrusion was carried out under conditions of a screw diameter of 45 mm, a screw rotation speed of 200 rpm, and screw L/D=35.

(3) Half Shell Formation

Compression molding of a half shell was carried out by charging a cover material in a pellet form obtained in the above-mentioned manner in a recessed part of a lower die for half shell molding and pressurizing the cover material to obtain a half shell. The compression molding was carried out at a molding temperature of 180° C., a molding time of 5 minutes, and a molding pressure of 100 kgf/cm$^2$.

(4) Cover Formation

The multilayer core obtained in (1) was covered with two half shells obtained in (3) and a cover was formed by compression molding. The molding was carried out at a molding temperature of 140° C., a molding time of 3 minutes, and a molding pressure of 100 kgf/cm$^2$. The surface of the obtained golf ball body was subjected to sandblast treatment and marking followed by coating a clear paint, drying at the temperature of 40 C.° in an oven to dry the paint to obtain a golf ball having a diameter of 42.7 mm and a weight of 45.4 g. The results of evaluating the resultant golf ball with respect to abrasion-resistance, and spin performance are shown in Table 3.

TABLE 3

| | Golf ball No. | | | | | | | | | | |
|---|---|---|---|---|---|---|---|---|---|---|---|
| | 1 | 2 | 3 | 4 | 5 | 6 | 7 | 8 | 9 | 10 | 11 |
| Cover composition (mass parts) | — | — | — | — | — | — | — | — | — | — | — |
| Nonionic Polyurethane 1 | 100 | — | — | — | — | — | — | — | — | — | — |
| Nonionic Polyurethane 2 | — | 100 | — | — | — | — | — | — | — | — | — |
| Nonionic Polyurethane 3 | — | — | 100 | — | — | — | — | — | — | — | — |
| Nonionic Polyurethane 4 | — | — | — | 100 | — | — | — | — | — | — | — |
| Nonionic Polyurethane 5 | — | — | — | — | 100 | — | — | — | — | — | — |
| Nonionic Polyurethane 6 | — | — | — | — | — | 100 | — | — | — | — | — |
| Nonionic Polyurethane 7 | — | — | — | — | — | — | 100 | — | — | — | — |
| Nonionic Polyurethane 8 | — | — | — | — | — | — | — | 100 | — | — | — |
| Nonionic Polyurethane 9 | — | — | — | — | — | — | — | — | 100 | — | — |
| Nonionic Polyurethane 10 | — | — | — | — | — | — | — | — | — | 100 | — |
| Nonionic Polyurethane 11 | — | — | — | — | — | — | — | — | — | — | 100 |
| Titanium oxide | 4 | 4 | 4 | 4 | 4 | 4 | 4 | 4 | 4 | 4 | 4 |
| Golf ball properties | — | — | — | — | — | — | — | — | — | — | — |
| Abrasion-resistance (points) | 4 | 4.5 | 5 | 4.5 | 4 | 2 | 2 | 1 | 2 | 2 | 2 |
| Spin rate (rpm) | 7000 | 7100 | 7000 | 6800 | 6600 | 6900 | 6400 | 5800 | 6700 | 6800 | 6700 |

Formulation: parts by mass

The golf balls No. 1 to No. 5 are golf balls each having the core and the cover covering the core, and each cover contains the nonionic polyurethane having a hard segment content satisfying the defined range of from 24.5% to 34.7% by mass. In each case, the golf balls were found excellent in the spin performance and abrasion resistance. On the other hand, the golf ball No. 6 is one in which the hard segment content in the nonionic polyurethane is less than 24.5% by mass and golf balls Nos. 7 and 8 are those in which the hard segment content in the nonionic polyurethane exceeds 34.7% by mass just like golf balls using a conventional polyurethane elastomer (e.g. Elastollan XNY 97A). It was found that these golf balls Nos. 6 to 8 were all considerably inferior in the abrasion resistance.

The present invention provides a golf ball having a polyurethane cover and which is useful as a golf ball excellent in the spin performance and abrasion resistance. This application is based on Japanese Patent application No. 2,007-246, 005 filed on Sep. 21, 2007, the contents of which are hereby incorporated by reference.

What is claimed is:

1. A golf ball comprising a core and a cover covering the core, wherein the cover contains a nonionic polyurethane having a hard segment content of from 24.5% to 34.7% by mass as a resin component, and the nonionic polyurethane contains an aromatic diol represented by the following formula (1) as a chain extender component (1)

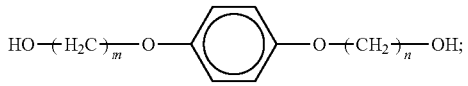

and wherein m and n independently denote an integer of 2 to 4, a polycarbonate polyol as a polyol component, wherein the polycarbonate polyol has, as a repeating constitutional unit, a repeating unit (A) shown in the following formula (2) and a repeating unit (B) shown in the following formula (3) and having a different structure from that of (A), and a mole ratio of (A)/(B) is from 30/70 to 70/30:

(2)

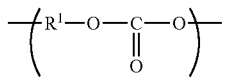

in formula (2), R' denotes a bivalent residue obtained by removing two hydroxyl groups from a diol having 4 to 6 carbon atoms; and (3)

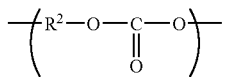

in formula (3), R$^2$ denotes a bivalent residue obtained by removing two hydroxyl groups from a diol having 4 to 6 carbon atoms.

2. The golf ball according to claim 1, wherein the aromatic diol is hydroquinonebis (2-hydroxyethyl)ether.

3. The golf ball according to claim 2, wherein $R^1$ denotes a bivalent residue obtained by removing two hydroxyl groups from 1,5-pentanediol and $R^2$ denotes a bivalent residue obtained by removing two hydroxyl groups from 1,6-hexanediol, and the mole ratio of (A)/(B) is 50/50.

4. The golf ball according to claim 3, wherein the nonionic polyurethane has a hard segment content of 25.4% to 28.6% by mass.

5. The golf ball according to claim 1, wherein R' denotes a bivalent residue obtained by removing two hydroxyl groups from 1,5-pentanediol and $R^2$ denotes a bivalent residue obtained by removing two hydroxyl groups from 1,6-hexanediol, and the mole ratio of (A)/(B) is 50/50.

6. The golf ball according to claim 1, wherein the nonionic polyurethane has a hard segment content of from 25.4% to 28.6% by mass.

7. The golf ball according to claim 6, wherein the aromatic diol is hydroquinonebis (2-hydroxyethyl)ether.

8. The golf ball according to claim 6, wherein $R^1$ denotes a bivalent residue obtained by removing two hydroxyl groups from 1,5-pentanediol and $R^2$ denotes a bivalent residue obtained by removing two hydroxyl groups from 1,6-hexanediol, and the mole ratio of (A)/(B) is 50/50.

* * * * *